United States Patent [19]

Foster

[11] 4,129,515

[45] Dec. 12, 1978

[54] HEAVY-DUTY LIQUID DETERGENT AND PROCESS

[75] Inventor: Gregory S. Foster, Cincinnati, Ohio

[73] Assignee: The Procter & Gamble Company, Cincinnati, Ohio

[21] Appl. No.: 877,631

[22] Filed: Feb. 14, 1978

Related U.S. Application Data

[63] Continuation of Ser. No. 722,917, Sep. 13, 1976, abandoned, which is a continuation-in-part of Ser. No. 615,270, Sep. 22, 1975, abandoned.

[51] Int. Cl.[2] ..... C11D 1/83; C11D 3/26

[52] U.S. Cl. ..... 252/117; 252/153; 252/548; 252/550; 252/551; 252/555; 252/558; 252/559

[58] Field of Search ..... 252/531, 532, 535, 539, 252/540, 550, 551, 554, 558, 559, 529, 548, DIG. 14

[56] References Cited

U.S. PATENT DOCUMENTS

| | | | |
|---|---|---|---|
| T903,009 | 10/1973 | Kastra | 252/559 |
| 2,766,212 | 10/1956 | Grifo | 252/551 X |
| 2,908,651 | 10/1959 | Grifo | 252/153 |
| 2,914,482 | 11/1959 | Kopp | 252/548 |
| 3,332,876 | 6/1967 | Walker | 252/551 X |
| 3,719,596 | 3/1973 | Shore et al. | 252/1 |
| 3,869,399 | 3/1975 | Collins | 252/118 |
| 3,969,282 | 7/1976 | Kappler et al. | 252/559 |
| 3,998,750 | 12/1976 | Payne et al. | 252/108 |

FOREIGN PATENT DOCUMENTS

| | | |
|---|---|---|
| 268261 | 11/1964 | Australia. |
| 559094 | 1/1958 | Belgium. |
| 1079974 | 11/1954 | France. |
| 1233047 | 10/1960 | France. |
| 945383 | 2/1964 | United Kingdom. |

*Primary Examiner*—P.E. Willis, Jr.

*Attorney, Agent, or Firm*—Julius P. Filcik; Richard C. Witte; Thomas H. O'Flaherty

[57] ABSTRACT

Single-phase, heavy-duty liquid detergent compositions containing detergency boosting levels of magnesium cations and alkanolamines are formulated by first under-basing with magnesium hydroxide and therafter adding the alkanolamine.

18 Claims, No Drawings

HEAVY-DUTY LIQUID DETERGENT AND PROCESS

This application is a continuation of application Ser. No. 722,917, filed Sept. 13, 1976, which is a continuation-in-part of application Ser. No. 615,270, filed Sept. 22, 1975, both abandoned.

BACKGROUND OF THE INVENTION

The present invention relates to homogeneous, single-phase liquid detergents. More specifically, liquid compositions comprising an anionic detersive surfactant, a nonionic detersive surfactant, a source of magnesium ions, and an alkanolamine are prepared in a manner which avoids undesirable phase separation.

Heavy-duty, built laundry detergents have historically been provided in the form of granules. More recently, however, it has been recognized that excellent detergency performance can be secured using unbuilt detergents comprising a mixture of detersive surfactants and materials such as alkanolamines. The advent of such compositions has made it possible to provide heavy-duty laundry detergents in liquid form.

Liquid detergent compositions offer several advantages over solid compositions. For example, liquid compositions are easier to measure and dispense into a laundering liquor. More importantly, liquid compositions are especially useful for direct application to heavily soiled areas on fabrics, after which the pre-treated fabrics can be placed in an aqueous bath for laundering in the ordinary manner.

Typical heavy-duty liquid detergents contain substantial amounts of nonionic surfactants which help provide grease and oil removal from synthetic and blend fabrics. However, many important types of detersive nonionic surfactants tend to form a separate phase in liquid compositions containing substantial amounts of electrolytes. Of course, phase separation (presumably, a manifestation of the so-called "salting-out" effect) is unacceptable when formulating homogeneous liquid detergents. Accordingly, the presence of electrolytes, especially water-soluble polyvalent inorganic salts, is usually avoided when preparing such compositions.

Preferred heavy-duty liquid detergents will also contain a substantial amount of one or more synthetic detersive anionic surfactants. The anionic surfactant helps provide improved cleaning performance over a broad spectrum of soils and fabric types. Moreover, the anionic surfactant provides the suds levels desired by most users of such products.

As noted above, alkanolamines, especially triethanolamine, are often used in heavy-duty liquid detergents to adjust pH and to provide a substantial increment of additional cleaning power.

It is well known in the detergency arts that certain polyvalent metal cations (especially when used in combination with synthetic anionic surfactants) can contribute substantially to detergency performance. Accordingly, it is desirable to incorporate a source of such cations into a detergent composition. In particular, calcium and magnesium salts of various types are useful detergency boosters, and salts such as magnesium acetate, the calcium and magnesium halides, magnesium sulfate, calcium and magnesium hydroxide, and the like, have been suggested for this purpose, especially in the formulation of heavy-duty granular detergents.

It has now been discovered that calcium and magnesium salts cannot be used in random fashion when preparing homogeneous heavy-duty liquid detergents since phase separation will occur. However, compositions prepared in the manner disclosed herein are stable, homogeneous liquids.

The co-pending application of Payne, et al., entitled LIQUID DETERGENT COMPOSITION, Ser. No. 592,009, filed June 30, 1975, now U.S. Pat. No. 3,998,750 discloses homogeneous liquid detergents containing magnesium salts and which can contain small, non-detersive amounts of alkanolamines.

The co-pending application of Hellyer, et al., Ser. No. 538,618, filed Jan. 6, 1975 abandoned in favor of application Ser. No. 634,389, also now abandoned in favor of application Ser. No. 669,531, filed on Mar. 23, 1976, discloses liquid detergent compositions which contain, inter alia, a source of magnesium ions and a mixture of surfactants, including anionics and amine oxides.

It is an object of this invention to provide homogeneous, heavy-duty liquid detergents which contain magnesium salts, alkanolamines, anionic surfactants and nonionic surfactants at levels which provide superior detergency performance.

PRIOR ART

The use of magnesium and/or calcium ions in detergent compositions to provide increased detergency benefits has been disclosed heretofore.

U.S. Pat. No. 2,908,651, entitled LIQUID DETERGENT COMPOSITION, Oct. 13, 1959, discloses single-phase, clear, concentrated liquid detergents containing, inter alia, alkanolamines, magnesium or calcium salts, alcohols, and alkyl aryl sulfonates. This patent describes in some detail the problems associated with the preparation of single-phase, clear liquid detergents.

U.S. Pat. No. 2,691,636, entitled DETERGENT COMPOSITIONS, Oct. 12, 1954, relates to synthetic detergent compositions and their use, inter alia, in their calcium and magnesium form.

U.S. Pat. No. 2,766,212, entitled DETERGENTS, Oct. 9, 1956, discloses and claims, inter alia, the use of polyvalent metals such as the chlorides, sulfates, acetates, etc., of magnesium, calcium, etc., in combination with anionic detergents which are sulfated ethoxylated alcohols.

U.S. Pat. No. 3,202,613, entitled PROCESS FOR PRODUCTION OF DETERGENT COMPOSITIONS, Aug. 24, 1965, teaches the use of magnesium sulfate in low bulk density built detergents.

U.S. Pat. No. 3,440,171, entitled SURFACE ACTIVE COMPOSITIONS, Apr. 22, 1969, teaches the use of various salts, including magnesium salts, as degellants for fluid mixtures of alkyl benzene sulfonic acids and alkanolamines.

U.S. Pat. No. 3,282,852, entitled HEAVY DUTY LIQUID DETERGENTS, Nov. 1, 1966, teaches, inter alia, hydrotropes, nonionics and higher alkaryl sulfonates in their alkanolamine or magnesium salt form.

U.S. Pat. No. Re27,096, reissued Mar. 23, 1971, teaches a high sudsing detergent composition comprising a synergistic mixture of olefin sulfonates, alkyl benzene sulfonates and alkyl ether sulfates and teaches that magnesium salts of these materials may be employed.

U.S. Pat. No. 3,718,609, entitled LIQUID DETERGENT COMPOSITIONS, Feb. 27, 1973, relates to dual layer liquid detergents which can contain magnesium surfactants.

U.S. Pat. No. 3,686,098, entitled NOVEL DETERGENT COMPOSITION, Aug. 22, 1972, relates to di-anionic detergents and the water-soluble calcium, magnesium, etc., salts thereof.

As can be seen from the foregoing, polyvalent metal ions such as calcium and magnesium have been employed in a variety of detergent compositions. Additional references in this regard include the following:

U.S. Pat. Nos. 3,819,539, June 25, 1974; 3,700,607, Oct. 24, 1972; 3,697,587, Oct. 10, 1972; 3,679,611, July 25, 1972; 3,679,609, July 25, 1972; 3,634,269, Jan. 11, 1972; 3,577,347, May 4, 1971 (relating to a stable, non-gritty cleanser composition comprising a detergent mixture which can be alkyl benzene sulfonate and a nonionic surfactant, certain magnesium salts, and a chlorine bleach); 3,505,395, Apr. 7, 1970; 3,384,595, May 21, 1968; 3,345,300, Oct. 3, 1967; 3,325,412, June 13, 1967; 3,303,137, Feb. 7, 1967; 3,274,117, Sept. 20, 1966; 3,265,624, Aug. 9, 1966 (chlorine bleach-containing composition); 3,256,202, June 14, 1966; 3,053,771, Sept. 11, 1962; 3,072,580, Jan. 8, 1963; 2,857,370, Oct. 21, 1958; 2,731,442, Jan. 17, 1956; 2,166,314, July 18, 1939; 2,562,155, July 24, 1951; 2,037,566, Apr. 14, 1936; 2,658,072, Nov. 3, 1953; and 2,717,243, Sept. 6, 1955.

In addition to the foregoing, U.S. Pat. Nos. 3,869,399, issued Mar. 4, 1975, 3,594,323, issued July 20, 1971, and the references cited therein, disclose various heavy duty liquid detergents and the use of high (ca. 1%, and greater) levels of free alkanolamines therein to enhance detergency performance.

While the present invention is especially useful with magnesium salts, surprisingly, the calcium salts precipitate and are not contemplated for use herein.

SUMMARY OF THE INVENTION

The present invention encompasses an improvement in the process for preparing a homogeneous (single-phase) heavy-duty liquid detergent composition which contains detersive amounts of both anionic and nonionic surfactants, as well as alkanolamines and magnesium salts, said improvement comprising:

(a) mixing the surfactant component comprising a detersive amount of an anionic surfactant, or mixtures thereof, in the free acid form, with sufficient magnesium hydroxide to provide a mixture characterized by a solution pH of from about 1 to about 5.5; and (b) thereafter admixing sufficient alkanolamine (preferably triethanolamine) with the foregoing mixture to provide a finished composition characterized by a solution pH of from about 6 to about 9.

The compositions prepared in the foregoing manner contain a detersive amount of a nonionic surfactant of the type disclosed hereinafter. The order of addition of the nonionic surfactant component is not critical. The nonionic can be added to the composition before or after reaction of the anionic surfactant with the magnesium hydroxide or before or after addition of the alkanolamine. Most preferably, the nonionic surfactant is added after the reaction with the alkanolamine.

In a preferred process, the mixing steps are carried out in a liquid medium, especially water or mixtures of water and water-soluble organic solvents which also serve as carrier liquids in the resulting compositions.

The present invention also encompasses liquid detergent compositions prepared according to the foregoing process, and their use in cleaning operations.

DETAILED DESCRIPTION OF THE INVENTION

The process of this invention is designed to provide stable, homogeneous, liquid detergent compositions comprising a detersive amount of: a surfactant component comprising a mixture of detersive anionic and nonionic surfactants; an alkanolamine, or mixtures of alkanolamines; and a source of magnesium cations.

The compositions prepared by the present process are specifically designed to provide optimal cleaning benefits when used in either of the two modes commonly employed with liquid detergent compositions. First, the compositions herein can be used as pre-treatment agents which are applied in concentrated form directly onto fabric stains prior to washing. Second, the instant compositions are also useful as detergents for conventional through-the-wash fabric laundering operations. Excellent stain removal and soil removal are attained when an effective amount of the instant compositions is dissolved in an aqueous washing solution. Typical use concentrations are usually at least about 0.05% by weight in an aqueous laundering liquor. For through-the-wash fabric laundering, a concentration in the range of from 0.08% to about 0.50% (preferably about ¼ cup per 17–19 gallons of wash water) by weight of the laundering liquor is generally employed. Of course, this can be adjusted, depending on the soil and fabric load and the desires of the user.

With regard to pre-treatment efficacy, the compositions prepared in the manner of this invention provide oily stain removal from cotton, polyester and polyester/cotton fabrics which is equal or superior to similar pre-treatment performance attained with conventional built anionic detergent compositions. The compositions herein are comparable in oily stain removal performance with pure nonionic surfactants which are known to be particularly useful in pre-treatment stain removal processes. On the other hand, the compositions herein are equal or superior to conventional nonionic surfactants for through-the-wash oily soil removal (especially from cotton) under standard home laundering conditions. Through-the-wash detergency performance of the instant compositions is comparable with that attained with conventional, built granular anionic detergent compositions.

The present process employs multiple components which are described in detail, below.

Detersive Surfactants

The surfactant component of the compositions prepared according to this invention ultimately comprises, as essential ingredients, an anionic detersive surfactant and a nonionic detersive surfactant. Additional surfactants, e.g., the semi-polar, zwitterionic and ampholytic surface-active agents well known in the detergent arts, can optionally be employed herein as suds modifiers, or for specialized cleaning purposes. Typical anionic, nonionic, etc., surfactants of the type used herein are listed in U.S. Pat. Nos. 3,332,880 and 3,697,364, issued Sept. 26, 1972, to J. B. Edwards, each incorporated herein by reference.

In the present process the anionic surfactants are used in their acid form. The anionics are first "under-based", i.e., partially neutralized with $Mg(OH)_2$, and thereafter at least partially neutralized with the alkanolamine. By proceeding in this manner, separation of the finished product (which also contains a detersive amount of a nonionic surfactant) into what is probably an aqueous electrolyte/anionic surfactant phase, a nonionic surfactant phase, and an undissolved solids phase is avoided.

It will be appreciated that commercial anionic surfactants (free acid form) often contain ca. 3-5% of unreacted $H_2SO_4$. In such cases addition of sufficient $Mg(OH)_2$ to neutralize the anionic surfactant still results in a pH in the range of 2-3. Of course, it is not possible to state what species ($MgSO_4$/anionic-Mg, etc.) exist in the reaction mixture at this stage. In any event, this is not important to the practice of this invention since, in fact, the mixture is being adjusted in the manner required to provide a clear, stable product. Accordingly, when using pure or impure anionics the procedure is the same: first, adjust pH in the acid range with $Mg(OH)_2$; second, adjust pH to near neutrality, neutrality or basicity with the alkanolamine.

Non-limiting examples of surfactants suitable for use in the instant compositions and processes are as follows.

Anionic Surfactant

The anionic component of the instant detergent compositions can be an organic sulfuric reaction product having in its molecular structure an alkyl group containing from about 8 to about 22 carbon atoms and a sulfonic acid or sulfuric acid ester group, or mixtures thereof. (Included in the term "alkyl" is the alkyl portion of acyl groups). Examples of this group of synthetic detersive surfactants which can be used in the present invention are the alkyl sulfates, especially those obtained by sulfating the higher alcohols ($C_8$-$C_{18}$ carbon atoms) produced from the glycerides of tallow or coconut oil; and alkyl benzene sulfonates, in which the alkyl group contains from about 9 to about 14 carbon atoms, in straight chain or branched chain configuration, e.g., those of the type described in U.S. Pat. Nos. 2,220,099 and 2,477,383, incorporated herein by reference. Linear straight chain alkyl benzene sulfonates in which the average of the alkyl groups is about 13 carbon atoms, abbreviated as $C_{13}$LAS, as well as mixed $C_{11.2}$ and $C_{11.8}$ (avg.) LAS are typically used. $C_{11}$-$C_{14}$ branched chain alkyl benzene sulfonates (ABS), which are excellent sudsers, can also be used.

Examples of commercially available alkyl benzene sulfonates (free acid form) useful in the instant invention include Conoca SA 515, SA 597, and SA 697, all marketed by the Continental Oil Company, and Calsoft LAS 99, marketed by the Pilot Chemical Company.

Other anionic surfactant compounds herein include the alkyl glyceryl ether sulfonates, especially those ethers of higher alcohols derived from tallow and coconut oil; coconut oil fatty acid monoglyceride sulfonates and sulfates; and alkyl phenol ethylene oxide ether sulfates containing about 1 to about 10 units of ethylene oxide per molecule and wherein the alkyl groups contain about 8 to about 12 carbon atoms.

Other useful anionic surfactants herein include the esters of $\alpha$-sulfonated fatty acids containing from about 6 to 20 carbon atoms in the ester group; 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein, but are less preferred than the sulfates and sulfonates. Higher fatty acids containing from about 8 to about 24 carbon atoms and preferably from about 10 to about 20 carbon atoms and the coconut and tallow soaps can also be used herein as corrosion inhibitors.

Preferred water-soluble anionic organic surfactants herein include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; and olefin suflonates containing from about 14 to 16 carbon atoms.

Specific preferred anionics for use herein include: the linear $C_{10}$-$C_{14}$ alkyl benzene sulfonates (LAS); the branched $C_{10}$ to $C_{14}$ alkyl benzene sulfonates (ABS); the tallow alkyl sulfates the coconut alkyl glyceryl ether sulfonates; the sulfated condensation products of mixed $C_{10}$-$C_{18}$ tallow alcohols with from about 1 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain non-interfering components which are processing by-products. For example, commercial $C_{10}$-$C_{14}$ alkaryl sulfonates can comprise alkyl benzene sulfonates, alkyl toluene sulfonates, alkyl naphthalene sulfonates and alkyl poly-benzenoid sulfonates. Such materials and mixtures thereof are fully contemplated for use herein.

Nonionic Surfactant

The compositions and processes herein also employ a nonionic detersive surfactant. The presence of the nonionic surfactant in the liquid detergent compositions provided by this invention promotes oily stain removal, both in their pre-treatment application and through-the-wash use.

The nonionic surfactants can be prepared by a variety of methods well known in the art. In general terms, such nonionic surfactants are typically prepared by condensing ethylene oxide with an —OH containing hydrocarbyl moiety, e.g., an alcohol or alkyl phenol, under conditions of acidic or basic catalysis.

Nonionic surfactants for use herein comprise the typical nonionic surface active agents well known in the detergency arts. Such materials can be succinctly described as the condensation products of an alkylene oxide (hydrophilic in nature), especially ethylene oxide (EO), with an organic hydrophobic compound, which is usually aliphatic or alkyl aromatic in nature. The length of the hydrophilic (i.e., polyoxyalkylene) moiety which is condensed with any particular hydrophobic compound can be readily adjusted to yield a water-soluble compound having the desired degree of balance between hydrophilic and lipophilic elements, i.e., the "HLB".

The HLB of the ethoxylated nonionics used herein can be experimentally determined in well-known fashion, or can be calculated in the manner set forth in Decker, EMULSIONS THEORY AND PRACTICE, Reinhold 1965, pp. 233 and 248. For example, the HLB of the nonionic surfactants herein can be simply approximated by the term: HLB = E/5; wherein E is the weight percentage of ethylene oxide content in the molecule. Of course, the HLB will vary, for a given hydrocarbyl content, with the amount of ethylene oxide.

Preferred nonionic surfactants for use in the present compositions and processes are characterized by an HLB in the range of from 9 to 20, most preferably 10 to 14.

Specific, non-limiting examples of suitable water-soluble nonionic surfactants include the following.

The ethylene oxide condensates of alkyl phenols are a well-known type of water-soluble ethoxylated nonionic surfactant. These compounds include the condensation products of alkyl phenols having an alkyl group containing from about 6 to 18 carbon atoms in either a straight chain or branched chain configuration, with EO, said EO being present in amounts from about 3 to about 25 moles of EO per mole of alkyl phenol. The alkyl substituent in such compounds can be derived, for example, from polymerized propylene, diisobutylene, octene, or nonene. Examples of compounds of this type include nonyl phenol condensed with about 9.5 moles of EO per mole of nonyl phenol; dodecyl phenol condensed with about 12 moles of EO per mole of phenol; dinonyl phenol condensed with about 15 moles of EO per mole of phenol; and di-isooctylphenol condensed with about 15 moles of EO per mole of phenol. Commercially available nonionic surfactants of this type include Igepal CO-630, marketed by the GAF Corporation, and Triton X-45, X-114, X-100 and X-102, all marketed by the Rohm and Haas Company.

The condensation products of aliphatic alcohols with ethylene oxide are another (and highly preferred) type of nonionic surfactant used herein. The alkyl chain of the aliphatic alcohol can be either straight or branched, and generally contains from about 8 to about 22, preferably 9 to 16, carbon atoms. The alcohols can be primary, secondary, or tertiary. Examples of such ethoxylated alcohols include the condensation product of about 6 moles of EO with 1 mole of tridecanol; myristyl alcohol condensed with about 10 moles of EO per mole of myristyl alcohol; the condensation product of EO with coconut fatty alcohol wherein the coconut alcohol is primarily a mixture of fatty alcohols with alkyl chains varying from 10 to about 14 carbon atoms in length and wherein the condensate contains about 6 moles of EO per mole of total alcohol; and the condensation product of about 9 moles of EO with the above-described coconut alcohol. Tallow alcohol ethoxylates $(EO)_6$ to $(EO)_{11}$ are similarly useful herein. Examples of commercially available nonionic surfactants of the foregoing type include Tergitol 15-S-9, marketed by the Union Carbide Corporation; Neodol 23-6.5, marketed by the Shell Chemical Company; and Kyro EOB, marketed by The Procter & Gamble Company.

The condensation products of ethylene oxide with a hydrophobic base formed by the condensation of propylene oxide with propylene glycol constitute another type of nonionic surfactant. The hydrophobic portion of these compounds has a molecular weight of from about 1500 to 18000 and, of course, exhibits water insolubility. The addition of poly-EO moieties to this hydrophobic portion tends to increase the water-solubility of the molecule as a whole, and the liquid character of the product is retained up to the point where the EO content is about 50% of the total weight of the condensation product. Examples of compounds of this type include certain of the commercially available Pluronic surfactants, marketed by BASF Wyandotte.

The condensation products of ethylene oxide with the product resulting from the reaction of propylene oxide and ethylenediamine are another type of nonionic surfactant useful herein. The hydrophobic "base" of these condensation products consists of the reaction product of ethylenediamine and excess propylene oxide, said base having a molecular weight of from about 2500 to about 3000. This base compound is thereafter condensed with EO to the extent that the condensation product contains from about 40 to about 80% by weight of poly-EO and has a molecular weight of from about 5,000 to about 11,000. Examples of this type of nonionic surfactant include certain of the commercially available Tetronic compounds, marketed by BASF Wyandotte.

The highly preferred nonionic surfactants herein include the $EO_1$-$EO_{20}$ condensates of $C_9$ to $C_{18}$ primary and secondary alcohols; the condensates of primary alcohols are most preferred. Non-limiting, specific examples of nonionic surfactants of this type are as follows (the abbreviations used for the nonionic surfactants, e.g., $C_{14}(EO)_6$, are standard for such materials and describe the carbon content of the lipophilic portion of the molecule and the ethylene oxide content of the hydrophilic portion): n-$C_{14}H_{29}(EO)_5$; n-$C_{14}H_{29}(EO)_6$; n-$C_{14}H_{29}(EO)_7$; n-$C_{14}H_{29}(EO)_{10}$; n-$C_{15}H_{31}(EO)_6$; n-$C_{15}H_{31}(EO)_7$; 2-$C_{15}H_{31}(EO)_7$; n-$C_{15}H_{31}(EO)_8$; 2-$C_{15}H_{31}(EO)_8$; n-$C_{15}H_{31}(EO)_9$; 2-$C_{15}H_{31}(EO)_9$; n-$C_{16}H_{33}(EO)_9$; and 2-$C_{16}H_{33}(EO)_9$.

It is to be recognized that mixtures of the foregoing nonionic surfactants are also useful herein and are readily available from commercial alcohol mixtures.

It will be appreciated that the degree of ethoxylation in the nonionics listed herein can vary somewhat, inasmuch as average fractional degrees of ethoxylation occur. For example, n-$C_{15}H_{31}(EO)_7$ can contain small quantities of n-$C_{15}H_{31}(EO)_0$ and n-$C_{15}H_{31}(EO)_{14}$. Commercial mixtures will contain portions of materials of varying EO contents, and the stated EO content represents an average. Such mixtures are quite suitable for use in the present compositions and processes.

Highly preferred alcohol-based nonionic surfactants are the $C_{14-15}(EO)_{6-9}$ materials disclosed hereinabove, which are commercially available as mixtures under the names Neodol 45-7 and Neodol 45-9 from the Shell Chemical Co. Neodol 45-7 is a liquid at ambient temperatures (and is more preferred herein for this reason) whereas Neodol 45-9 is a solid at room temperature. However, solid nonionics such as Neodol 45-9 are also useful in the instant liquid compositions inasmuch as they readily dissolve therein. Other highly preferred nonionics include Dobanol 91-8 ("OXO"-based alcohol from Shell) and Softanol, available from Nippon Shokubei.

When using commercial nonionic mixtures, especially of lower ($C_9$–$C_{10}$) alkyl chain length, it is preferred that the un-ethoxylated alcohols and lower $(EO)_1$-$(EO)_2$ ethoxylates be removed, or "stripped", to reduce undesirable odors. Stripping can be done in vacuo or by standard distillation means.

The Alkanolamine

The compositions prepared according to the present process are at least partially neutralized, or preferably over-based, to a pH of 6 or above using an alkanolamine. In order to secure optimal detergency performance, it is preferred that the compositions contain at least 1%, more preferably ca. 3–15%, of free (i.e., unreacted) alkanolamine by weight of composition.

The alkanolamine compound used herein is preferably selected from the group consisting of monoethanolamine, diethanolamine, triethanolamine (most preferred), and mixtures thereof. These alkanolamine compounds are produced by the reaction of ethylene oxide with ammonia in well-known fashion. The pure compounds can be recovered by standard distillation procedures.

The alkanolamine used in the present compositions and processes serves at least two purposes. First, the alkanolamine helps neutralize the free acid form of the anionic surfactant, presumably to provide, at least in part, the highly soluble alkanolamine salt. The high solubility of the alkanolamine-anionic would help explain the excellent clarity of the liquid detergent products prepared by the instant process. In addition, the excess (or "free") alkanolamine, itself, contributes to detergency performance, perhaps by interacting with oily soil, as well as by serving as a buffering agent which helps maintain the product pH within the desired range.

Adjunct Surfactants

The compositions and processes herein can optionally employ various other adjunct surfactants which can be used to perform specific cleaning, suds modifying, etc., functions. Such optional surfactants include the various semi-polar, ampholytic, and zwitter-ionic surface active agents known in the art. Non-limiting examples of such materials are as follows.

Semi-polar surfactants useful herein include water-soluble amine oxides containing one alkyl moiety of from about 10 to 28 carbon atoms and two moieties selected from the group consisting of alkyl moieties and hydroxyalkyl moieties containing from 1 to about 3 carbon atoms; water-soluble phosphine oxides containing one alkyl moiety of about 10 to 28 carbon atoms and two moieties selected from the group consisting of alkyl moieties and hydroxyalkyl moieties containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms, and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water solubilizing group.

The foregoing surfactant types are well known in the detergency arts.

Carrier

Although useful detergent compositions prepared in the manner of this invention need only contain the above-described components (i.e., thick, anhydrous compositions), highly preferred compositions herein contain, in addition to the active detersive components, a liquid carrier (solvent) selected from the group consisting of water and mixtures of water and water-soluble solvents. It will be appreciated that the partial neutralization of the acid form of the anionic surfactants using the magnesium hydroxide and the subsequent addition of alkanolamine can be most easily carried out when the surfactant is dissolved in a carrier liquid such as water or water/organic solvent mixtures. Moreover, it is convenient and preferred to use an aqueous solution of the magnesium hydroxide in the initial, under-basing step of the process.

The amount of carrier liquid/neutralization solvent used herein is preferably chosen to provide a finished composition which comprises from about 5% to 70%, preferably 20% to 60%, of carrier by weight of the total detergent composition. Highly preferred compositions comprise from about 25% to 45% by weight of the carrier liquid, and a corresponding amount of liquid is used in the process.

The presence of the carrier liquid at the above-disclosed levels in the compositions prepared according to this process results in several advantages. First, the physical stability of the detergent compositions is improved by dilution, and clear points are lowered. Stated otherwise, compositions formulated using liquid carriers do not cloud at the low temperatures which are commonly encountered during shipping or storing of commercially marketed detergent compositions.

Secondly, liquid carriers, especially water-alcohol mixtures, help control viscosity and regulate the gelling tendency which liquid detergent compositions of the instant type exhibit after dilution with water. Moreover, any tendency to gelation during processing is substantially avoided.

When an alcohol-water mixture is employed as a liquid carrier solvent herein, the weight ratio of water to alcohol preferably is maintained above about 2:1, more preferably from about 3:1 to about 10:1. Higher alcohol (particularly ethanol) concentrations in the water-alcohol mixtures used as carriers herein are preferably avoided because of flammability problems which may arise at such higher alcohol levels.

Any alcohol containing from 1 to about 5 carbon atoms can be employed in the water-alcohol carrier used to prepare the instant detergent compositions. Examples of operable alcohols include methanol, ethanol, propanol, isopropanol, butanol, isobutanol, and pentanol; ethanol is highly preferred for general use.

Various liquid or low-melting, water-soluble poly-ols can also be used in the carriers herein. Such materials include, for example, polyethylene glycol, especially the ethylene glycols in the molecular weight range of 500–1500; the polyethoxylated poly-ols commercially available as Carbitol; glycerines and polymers thereof; and the like.

Other water-soluble solvents which can be used herein in a manner similar to the alcohols include: ketones such as acetone; aldehydes such as propionaldehyde; ethers such as diethyl ether, and the like; as well as various natural water-soluble oils which contain such water-soluble organic solvents.

Optional Components

Compositions prepared according to this invention can optionally contain various non-interfering components which contribute to overall aesthetics, ease-of-use and performance. For the most part, such components can be added at any time during processing, but are preferably added after the initial under-basing step. Conveniently, the optionals are added as aqueous or aqueous-alcoholic solutions.

One type of optional component which can be used herein is an electrolyte salt. As pointed out in U.S. Pat. Nos. 2,580,173 and 3,440,171, electrolyte salts lessen undesirable gel formation which can occur with concentrated detergent compositions. This gel formation most often occurs, not in the product itself, but in measuring caps when a small quantity of water comes in contact with the concentrated composition. However, as noted above, high levels of electrolytes can cause phase separation in the instant compositions. To avoid this, non-interfering electrolyte degellants, i.e., those which do not contribute to phase separation, can be used at non-interfering levels, i.e., generally 1% by weight of composition, or less. Potassium hydroxide and potassium chloride are useful herein without causing phase separation. Potassium hydroxide and/or potassium chloride, used herein in combination with a water-alcohol solvent at a level of from about 0.1% to about 0.8% by weight of composition, can help eliminate gelling problems without the need for excessively high alcohol levels.

Other optional, non-essential, non-interfering components can be added to the compositions prepared herein to provide improved performance or aesthetic appeal. For example, compositions containing a color stabilizing agent such as citric acid are preferred from an aesthetic standpoint. Citric acid (or citrate) containing compositions exhibit surprising stability against the tendency of nonionic/anionic/alkanolamine compositions to develop a reddening upon storage. In addition, the presence of citric acid in the compositions has a beneficial effect from the standpoint of eliminating reddish stains which can sometimes develop on the outer surfaces of plastic bottles after spillage, seepage or handling of bottles with hands previously contacted with the compositions herein. An amount of citric acid of up to about 1% by weight of composition (based on its free acid form) can be added during processing to obtain these color stabilizing benefits. A highly preferred range for the added citric acid is from about 0.05% to about 0.30% by weight of composition. The citric acid is added after the initial under-basing step.

Suds modifying agents can be present in the instant compositions in minor proportions to provide high foaming or low foaming products, as desired. While the compositions herein inherently provide adequate suds levels, some users desire copious lather from laundry detergent products. Accordingly, the compositions herein can optionally contain suds boosters. Nonionic surfactants in the $C_{10-14}EO_{4-9}$ range are quite useful for this suds boosting purpose, as are ABS-type anionics. Various suds suppressors, such as the silicones or polyethylene oxide/polypropylene oxide copolymers known in the detergency arts, can be used if low-sudsing compositions are desired. Suds modifiers can be added at any convenient stage in processing.

Other optional components useful herein are listed in many commercial publications and include enzymes, brighteners, bleaching agents, anti-microbial agents, corrosion inhibitors, perfumes and coloring agents. Such components usually will comprise no more than about 3% by weight of the total composition. Such components can be added at any convenient stage of processing.

The fatty acid "soaps" noted hereinabove, especially oleic acid, are useful as product stabilizers and corrosion inhibitors which protect washer parts.

Preparation and Usage

The present compositions are prepared by first combining the anionic surfactant or anionic mixture with magnesium hydroxide base at a ratio which provides a solution pH (measured as a ca. 0.1% by weight aqueous solution) of from about 1 to about 5.5. A solution pH of from about 3 to about 5 is preferred where high agitation is achievable and longer reaction times are tolerable while a pH of from about 1 to about 3 is preferred where the high agitation and long reaction times are impractical, e.g. on a commercial scale. The reactants are simply mixed until the partial neutralization process is complete. Thereafter, the under-based anionic surfactant component is at least partially neutralized, or, preferably over-based, using the alkanolamine to a pH in the range from about 6 to about 9, preferably about 7 to about 9, more preferably about 7 to about 8 (ca. 0.1% aqueous solution). The resulting mixture of detersive ingredients can be used per se, or, more preferably, is prepared and used in a liquid carrier of the type disclosed hereinabove.

In a highly preferred mode, the process herein is carried out in the presence of a carrier liquid which serves as a reaction solvent for the anionic surfactant and the $Mg(OH)_2$, and as a carrier in the finished product. In a typical preparation, an anionic surfactant such as $C_{11.2}$ LAS, acid form, is dissolved in water. The LAS solution is then added to an aqueous solution of magnesium hydroxide until pH in the range of from about 1 to about 5.5, more preferably from about 1 to about 3, is reached. Following this, the nonionic surfactant and optional ingredients are added and the final pH of the solution is adjusted to the range of about 7 to about 8 with the alkanolamine.

Highly preferred detergent compositions herein have a pH in the range from about 7 to about 8, inasmuch as detergency performance of the surfactant components is increased at pH's at, or above, substantial neutrality. (In concentrated compositions containing magnesium cation, a pH in the range much above about 8.5 is preferably avoided, inasmuch as magnesium hydroxide begins to precipitate from concentrated solutions above that pH.)

It will be appreciated by those skilled in the art that the actual "form" in which the anionic surfactant exists in the finished composition is impossible to determine with acuracy. Presumably, much of the anionic is present as the magnesium salt; still another portion of the anionic is present as the alkanolammonium salt. Mixed, complex anionic-magnesium-alkanolamine species may also be present. In any event, knowledge of the exact species in the compositions is not important, as long as the ingredients are mixed in the manner described herein.

The following are non-limiting examples of the process of this invention and compositions prepared therewith. As can be seen from the examples, highly preferred compositions herein contain the nonionic and anionic surfactants at a weight ratio (free acid form of the anionic) of from about 5:1 to 1:5, most preferably 3:1 to 1:3.

EXAMPLE I

A stable, clear liquid detergent composition is prepared using the following detersive ingredients. The proportions listed reflect the amount of ingredient present in the final composition.

| | Parts by Weight |
|---|---|
| Surfactants | |
| $C_{11.2}$ LAS, acid form | 20.5 |
| Tallow alcohol $(EO)_{11}$ | 6.0 |
| Dobanol 91-8* | 19.0 |
| Carrier | |
| Ethanol | 8.0 |
| Water | 37.2 |
| Base | |
| Magnesium hydroxide | 1.4 |
| Triethanolamine | 5.0 |
| Minors | |
| Oleic acid | 1.0 |
| Citric acid | 0.2 |
| Dye, perfume, etc. | 0.2 |

*Branched "OXO" alcohols in the 9-11 chain length with an 8 ethoxylate average, available from Shell; said alcohols being vacuum stripped of the free alcohols and lower ethoxylates to help control odor.

The composition of Example I is prepared by dissolving the surfactants in about 75% of the water-ethanol carrier and adding the surfactant solution to a solution of magnesium hydroxide dissolved in the balance of the carrier. The minors are then added and the pH of the final composition is adjusted to 8.2 with the triethanolamine. (Sufficient triethanolamine is used to provide ca. 2.5% by weight unreacted, i.e., "free", triethanolamine in the composition.)

The composition prepared in the manner of Example I is a clear, stable, single-phase liquid.

The composition of Example I is used at a concentration of ca. 0.15% by weight in an aqueous laundering liquor at a temperature of ca. 110° F. to launder a mixed load of cotton, cotton/polyester and polyester fabrics. Oily soils and stains on the fabrics are substantially removed during the laundering operation, which is carried out in a standard, top-loading automatic washer according to manufacturer's instructions.

The composition of Example I is also characterized by its excellent suds profile. Accordingly, the composition is also useful in front-loading machines and in wringer-type washers at temperatures from about 90° F. to about 180° F.

In contrast with the foregoing, a commercial liquid detergent comprising an anionic surfactant, a nonionic surfactant, free triethanolamine, and a water-ethanol carrier is modified by the addition of ca. 1.2% by weight of magnesium chloride. On standing, the product separates into two distinct phases.

EXAMPLE II

A clear, stable, heavy-duty liquid detergent composition of the indicated, finished formula is prepared as follows.

| Ingredient | % (wt.) |
|---|---|
| Softanol* | 16.5 |
| $C_{11.8}$ LAS, acid form | 16.5 |

-continued

| Ingredient | % (wt.) |
|---|---|
| Magnesium hydroxide | 1.1 |
| Ethanol | 9.0 |
| Triethanolamine | to pH 8.5 |
| Water | Balance |

*$C_{12-13}$ (avg.) secondary alcohol mix ethoxylated to an average $(EO)_{12}$ chain; available from Nippon Shokubei. The commercial mixture is substantially free from non-ethoxylated alcohols and short-EO ethoxylates.

The composition of Example II is prepared by first partially neutralizing a solution of the $C_{11.8}$ LAS dissolved in the water-ethanol with the magnesium hydroxide (pH ca. 3). The Softanol is then added and the pH of the composition is adjusted to 8.5 with the triethanolamine. The resulting single-phase composition is storage-stable.

An aliquot of the composition of Example II is poured full-strength onto heavily soiled areas of fabrics. The fabrics are rubbed and thereafter placed in a standard, top-loading automatic washer together with an additional aliquot of the composition (total composition ¼ cup). The machine is operated according to manufacturer's instructions. After rinsing and drying, oily stains are found to be removed.

In the composition of Example II, the $C_{11.8}$ LAS is replaced by $C_{12}$ (avg.) ABS and a high sudsing product is secured.

In the composition of Example II, one-half the $C_{11.8}$ LAS is replaced by $C_{12-13}$ ABS and an excellent moderate-to-high sudsing product is secured.

In the process for preparing the composition of Example II, the triethanolamine is replaced by monoethanolamine and diethanolamine, respectively, and the pH of the product in each instance is adjusted to ca. 8.5 therewith. Substantially the same results are secured.

EXAMPLE III

A liquid detergent composition is prepared using the following components:

| | Parts by Weight |
|---|---|
| $C_{11.4}$ LAS, acid form | 28.9 |
| Neodol 45-7* | 15.0 |
| Water | 41.6 |
| Ethanol | 6.5 |
| Magnesium hydroxide | 2.6 |
| Triethanolamine | 3.5 |
| Coconut fatty acid | 1.0 |
| Citric acid | 0.1 |
| Dye, perfume, brightener | 0.8 |

*Neodol 45-7 is a nonionic surfactant of formula $C_{14-15}(EO)_7$.

The water, magnesium hydroxide and citric acid are mixed to form a slurry and thereafter the LAS is added. The resultant solution has a pH of about 1.5. The coconut fatty acid is next added. Then the triethanolamine is added to form a solution having a pH of about 7.5. The Neodol 45-7, ethanol, brightener, dye and perfume are finally added to form the detergent composition.

The composition remains stable for a prolonged time period and possesses satisfactory cleaning ability.

What is claimed is:

1. In a process for preparing a clear homogeneous heavy-duty liquid detergent composition which contains a surfactant component comprising detersive amounts of both anionic and nonionic surfactants, as well as alkanolamines and magnesium salts, the improvement which comprises:

(a) mixing the surfactant component comprising a detersive amount of an anionic surfactant, or mixtures thereof, in the free acid form, with sufficient magnesium hydroxide to provide a mixture characterized by a solution pH of from about 1 to about 5.5; and (b) thereafter admixing sufficient alkanolamine with the foregoing mixture to provide a finished composition characterized by a solution pH of from about 6 to about 9.

2. A process according to claim 1 wherein the surfactant component comprises a detersive amount of an anionic surfactant, or mixtures thereof, in the free acid form, and a detersive amount of a nonionic surfactant.

3. A process according to claim 2 wherein the anionic surfactant is a member selected from the group consisting of linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to about 18 carbon atoms and wherein the average degree of ethoxylation varies between 1 and 12; the sulfated condensation products of tallow alcohol with from about 3 to about 12 moles of ethylene oxide; olefin sulfonates containing from about 14 to about 16 carbon atoms; soaps; and mixtures thereof.

4. A process according to claim 3 wherein the nonionic surfactant is the condensate of ethylene oxide with an alcohol or alkyl phenol.

5. A process according to claim 4 wherein the nonionic surfactant is the condensate of 1 to 20 moles of ethylene oxide with a $C_9$–$C_{18}$ primary or secondary alcohol, or mixture of said condensates.

6. A process according to claim 1 wherein the alkanolamine is a member selected from the group consisting of monoethanolamine, diethanolamine, and triethanolamine.

7. A process according to claim 1 which is carried out in the presence of a solvent selected from the group consisting of water and mixtures of water and a water-soluble organic solvent.

8. A process according to claim 1 wherein the surfactant component is mixed with sufficient magnesium hydroxide to provide solution pH of from about 1 to about 3.

9. A process according to claim 8 wherein the finished composition is characterized by a solution pH of from about 7 to about 9.

10. A process according to claim 9 wherein the finished composition is characterized by a solution pH of from about 7 to about 8.

11. A detergent composition prepared by:

(a) mixing a surfactant component comprising a detersive amount of an anionic surfactant, or mixtures thereof, in the free acid form, with sufficient magnesium hydroxide to provide a mixture characterized by a solution pH of from about 1 to about 5.5; and (b) thereafter admixing sufficient alkanolamine with the foregoing mixture to provide a finished composition characterized by a solution pH of from about 6 to about 9.

12. A composition according to claim 11 wherein the surfactant component comprises a detersive amount of an anionic surfactant, or mixtures thereof, in the free acid form, and a detersive amount of a nonionic surfactant.

13. A composition according to claim 12 wherein the anionic surfactant is a member selected from the group consisting of linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to about 18 carbon atoms and wherein the average degree of ethoxylation varies between 1 and 12; the sulfated condensation products of tallow alcohol with from about 3 to about 12 moles of ethylene oxide; olefin sulfonates containing from about 14 to about 16 carbon atoms; soaps; and mixtures thereof.

14. A composition according to claim 13 wherein the nonionic surfactant is the condensate of ethylene oxide with an alcohol or alkyl phenol.

15. A composition according to claim 13 wherein the nonionic surfactant is the condensate of 1 to 20 moles of ethylene oxide with a $C_9$–$C_{18}$ primary alcohol, or mixtures of said condensates.

16. A composition according to claim 15 wherein the alkanolamine is a member selected from the group consisting of monoethanolamine, diethanolamine and triethanolamine.

17. A composition according to claim 16 which comprises from about 5% to about 70% by weight of a solvent selected from the group consisting of water and mixtures of water and a water-soluble organic solvent.

18. A composition according to claim 17 wherein the surfactant component is mixed with sufficient magnesium hydroxide to provide a mixture characterized by a solution pH of from about 1 to about 3 and thereafter admixed with sufficient alkanolamine to provide a finished composition characterized by a solution pH of from about 7 to about 8.

* * * * *